US008323086B2

(12) United States Patent
Demsetz et al.

(10) Patent No.: US 8,323,086 B2
(45) Date of Patent: Dec. 4, 2012

(54) GAMING APPARATUS WITH GEOMETRICALLY ORIENTED GAME ELEMENTS

(75) Inventors: Randy Demsetz, Volo, IL (US); Lawrence Hodgson, Kildeer, IL (US); Leonid Smikun, Glenview, IL (US)

(73) Assignee: Incredible Technologies, Inc., Vernon Hills, IL (US)

( * ) Notice: Subject to any disclaimer, the term of this patent is extended or adjusted under 35 U.S.C. 154(b) by 476 days.

(21) Appl. No.: 12/331,994

(22) Filed: Dec. 10, 2008

(65) Prior Publication Data

US 2009/0156295 A1 Jun. 18, 2009

Related U.S. Application Data

(60) Provisional application No. 61/007,603, filed on Dec. 14, 2007.

(51) Int. Cl.
*A63F 9/24* (2006.01)

(52) U.S. Cl. ..... 463/15; 463/16; 463/19; 463/21

(58) Field of Classification Search ..... 463/15–21
See application file for complete search history.

(56) References Cited

U.S. PATENT DOCUMENTS

| | | | | |
|---|---|---|---|---|
| 5,980,384 | A * | 11/1999 | Barrie | 463/16 |
| 2005/0054420 | A1* | 3/2005 | Cregan et al. | 463/20 |
| 2008/0085772 | A1* | 4/2008 | Iddings et al. | 463/42 |
| 2009/0061983 | A1* | 3/2009 | Kaufman | 463/20 |
| 2009/0118004 | A1* | 5/2009 | Hoffman | 463/31 |
| 2009/0124325 | A1* | 5/2009 | Wadleigh et al. | 463/20 |

* cited by examiner

*Primary Examiner* — Hsien Ming Lee
(74) *Attorney, Agent, or Firm* — Husch Blackwell LLP

(57) ABSTRACT

A gaming apparatus with geometrically oriented elements is disclosed. Specifically, an array of game elements are displayed, each of which has a discrete geometric orientation, and whose relative geometric orientations, in addition to relative placement of each gaming element, determines winning patterns which result in payout to a player.

13 Claims, 1 Drawing Sheet

GAMING APPARATUS WITH GEOMETRICALLY ORIENTED GAME ELEMENTS

BENEFIT CLAIM

This application claims the benefit of U.S. Provisional Application No. 61/007,603, filed Dec. 14, 2007.

OBJECTS OF THE INVENTION

An object of the invention is to provide a gaming apparatus with geometrically oriented game elements.

A second object of the invention is to provide a gaming apparatus with geometrically oriented game elements which is integrated into a gaming experience in which the geometric orientation of the gaming elements is appropriate.

A third object of the invention is to provide a new and improved gaming experience by integrating new methods of play into familiar archetypes to allow players to easily understand the new gaming experience.

Other objects and advantages of the invention will become apparent in the following disclosure.

SUMMARY OF THE INVENTION

The present invention relates to a gaming system having geometrically oriented game elements. Whereas in a traditional slot machine, whether electronic, mechanical, or a hybrid of both, the game elements are formed into a two-dimensional array and the relative positions of gaming elements (e.g., the gaming elements may form a horizontal line of like elements) determines whether the player has won a prize, in the invention, the gaming elements have individual geometric orientations, the asymmetrical gaming elements having a fixed number of distinguishable orientations within their individual locations in the array and the orientation of an element or elements is itself determinative of the prize, if any, paid to a player. This allows both a new and novel form of presentation and the integration of games that logically call for a horizontal movement of game elements.

BRIEF DESCRIPTION OF THE DRAWINGS

The characteristic features of the invention will be particularly pointed out in the claims. The descriptions of the preferred embodiment refer to the preceding drawings:

DESCRIPTION OF THE PREFERRED EMBODIMENT

The description of the preferred embodiment uses the invention in a gaming apparatus of the type usually referred to as a "slot machine." It could be used in any appropriate gaming or entertainment device, including but not limited to such things as a video poker game, a video keno game, a combination gaming machine, or even a coin-operated or bartop amusement device.

Figure 1:
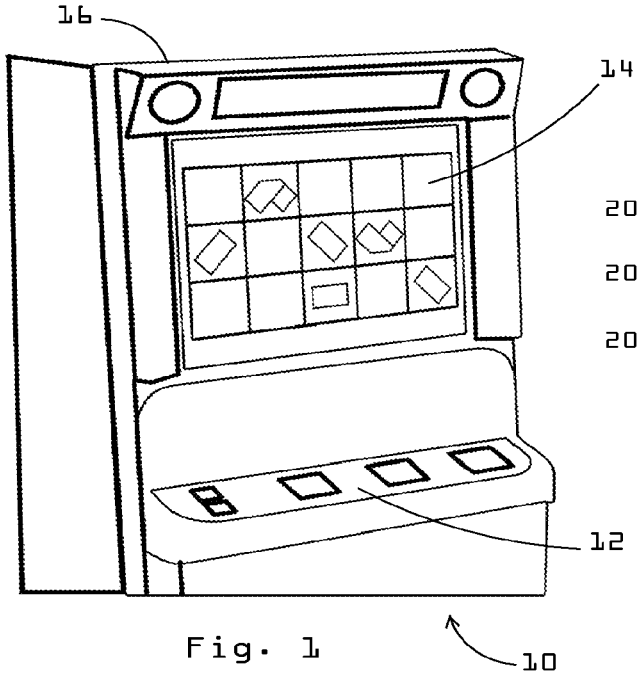
FIG. 1 is an abstract representational view of the entire apparatus.

By referring to FIG. 1, the basic concept of the invention may be easily understood. Gaming Unit 10 comprises cabinet 16, which contains user control array 12 and display 14, which displays the gaming elements during play. (See FIGS. 2, 3, 4.) Display 14 could be a cathode-ray tube, an LCD or LED monitor, or any other suitable display means. The player uses control array 12 to control the game, after either having inserted money or electronically provided the game with the player's account information for cashless play. Here control array 12 comprises a fixed number of rectangular buttons, but it could be a keyboard, a touch-screen, or any other desired combination of controls able to accept input from a player. The game uses any desired means of selecting gaming elements, either through the operation of chance, the exercise of skill, or both, and displays the results on the display 14, after which the player is rewarded for winning combinations if any are present. Within cabinet 16, as is customary with gaming machines in the art, is a computer unit with a processor, a main memory which contains dynamic information processed by the processor during operation, and a static memory which contains the fixed information, such as an operating system, game programs, and configuration information, necessary for the processor to consistently process input from the control array 12 and produce output to the display in response to a player's action.

Figure 2:
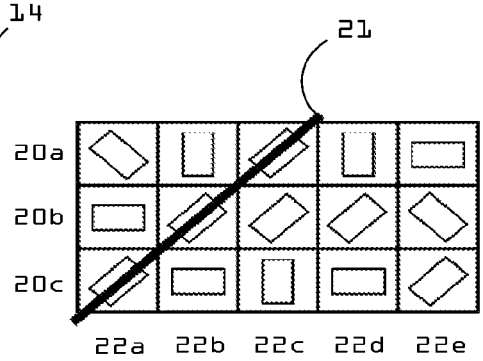
FIG. 2 is an abstract representational view of an embodiment of the display of the apparatus.

FIG. 2 shows an abstracted possible outcome of a game played on gaming unit 10 (Not shown: see FIG. 1.) Here, all the symbols are the same—simple rectangles. For purposes of simplicity no other symbols are shown: in a similar gaming apparatus under the prior art, additional symbols would be present, or every pull would be a winning combination. Similarly, while not shown, as discussed below other symbols would typically be present in an actual real-world application of the invention, some of which would have individual geometric orientations which varied and some of which might not have such individual geometric orientations and/or might only ever be represented in a single geometric orientation. While all these rectangles are otherwise identical, they have been rotated about their geometric centers to varying degrees, giving each an individual geometric orientation. While there is no theoretical limit to the number of orientations possible, it is preferred to keep the number of individual orientations limited so as to make the number of outcomes reasonably low and the individual outcomes easily distinct to the player. Normally, this would present a completely winning field on a typical slot machine, since proximity of identical symbols is all that is required to make a winning combination. However, in the invention, the proximity of individual symbols only produces a winning combination if the line connecting them is oriented in the same direction as their individual geometric orientations as it passes through them. Only the rectangles connected by line 21 are in the geometric orientation necessary to make a complete line of three oriented elements with the line connecting them in the same orientation as their individual geometric orientations, and using the invention, only this constitutes a winning combination. It is preferred, but not required, that the total universe of symbols in actual practice include multiple types of symbols. It is acceptable for some of the symbols to have no orientation at all, including "nulls" which cannot form part of a winning combination, "bonus elements" which might by their singular presence cause the player to win a prize, or multiple elements having individual orientations which are not allowed to form winning geometric orientations. For instance, if part of the universe of potential symbols were stylized representations of current U.S. paper currency, their rectangular shapes would correspond to the described embodiment of FIG. 2, with some added indication of denomination, but could have the additional requirement that only shapes comprised of identical denominations would be considered winning combinations. Although it does not form part of the claimed invention, it is further disclosed herein that such usages could also control the amount of a paid prize—a line of $10 bills might pay ten times the prize paid by a line of $1 bills. Obviously it is required that there be some means of defining an individual geometric orientation for each symbol. Symbols must either be asymmetric in shape, or have some patterning or other graphic indication of which orientation they are in. It is preferred, as shown, that the symbols whose individual geometric orientation is relevant to the outcome of the game be asymmetrical in shape.

It will be obvious to those of ordinary skill in the art that adding geometric orientation allows for a far larger number of total possible outcomes without adding additional symbols to the universe of possible selections. Among other advantages, this allows a larger sub-universe of winning combinations than is practical without the invention. For instance, a line of two properly oriented elements might win a small prize, even in a game with a relatively small universe of symbols, whereas this might not be practical in a game where only the proximity of similar symbols is evaluated when determining winning combinations. While there are any number of potential means for evaluating the outcome of a game, in general, the computer unit in Cabinet 16 contains, within its static memory, either an algorithm for examining a particular outcome against a fixed set of rules to determine whether it is a winning outcome, or a list of all possible winning outcomes against which the particular outcome of a game can be compared. The computer unit would determine the outcome of a particular game using the rules stored in the static memory, and recognize the outcome as a particular individual outcome. As is typical in the art, it would start from some first configuration, typically the configuration produced by the particular individual outcome of the prior game, randomly reorganize the game elements, and display the reorganized game elements as a second configuration which would be the particular individual outcome of the current game. In the prior art, the individual game elements would be symbols whose individual geometric orientation within a fixed geometric pattern never changed, only their relative location within the fixed geometric pattern. In the invention, both the relative location and the individual geometric orientations of the game elements can change, and the computer unit recognizes the relative locations and individual geometric orientations of the game elements and compares them to possible winning outcomes to determine if the particular individual outcome is a winning outcome.

Figure 3:
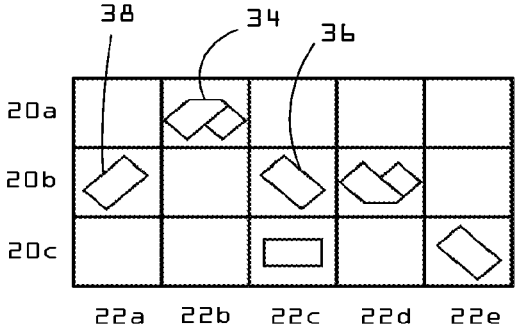
FIG. 3 is an abstract representational view of an embodiment of the display of the apparatus showing an alternative proper geometric orientation of game elements.

FIG. 3 shows an alternate possible combination of game elements detailing one of the possibilities that the invention makes practical. Rows 20*a*, 20*b*, and 20*c* and columns 22*a*, 22*b*, 22*c*, 22*d*, and 22*e* contain game elements (in this case, abstract geometric figures.) While it is permissible to use abstract game elements and symbols, it is also permissible and may be desirable to style the game elements as objects that might have similar multiple orientations in the real world, e.g. the elements could be dollar bills or other monetary notes folded into a variety of shapes. Other possibilities include people or animals oriented at different angles, only one of which represents a line of sight, vehicles which move in a fixed direction relative to their orientation, or any other desired representation.

Figure 4:
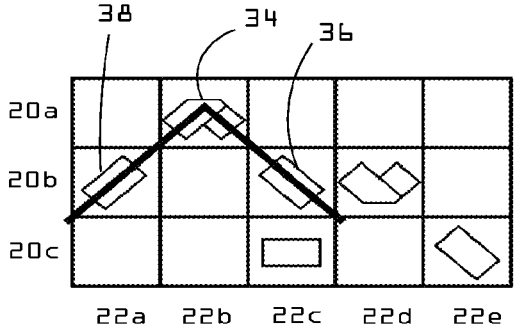
FIG. 4 is an abstract representational view of an embodiment of the display of the apparatus showing the proper geometric orientation of game elements.

FIG. 4 shows the game elements of FIG. 3 in a final position and demonstrates the winning and non-winning orientation of game elements. First game element 34 is oriented to form a downward-opening ninety-degree angle, with parts of the element oriented to one hundred and thirty five degrees from the vertical and two hundred and twenty five degrees from the vertical. Second game element 36 is oriented at three hundred and fifteen degrees from the vertical, which aligns it with the one of the downward parts of first game element 34. Similarly, third game element 38 is oriented at forty five degrees from the vertical, aligning it with the other downward part of first game element 34. Together, first game element 34, second game element 36, and third game element 38 form a larger coherent pattern of aligned elements, emphasized by the heavy black line. This might be considered a winning configuration and produce a prize of some type. While a traditional slot machine might offer a prize for a similar configuration of non-geometrically-oriented elements—to analogize to the described embodiment, it might "pay on triangles of matching symbols"—a slot machine incorporating the invention allows the player to easily envision such winning combinations and understand intuitively why a given combination is a winning combination. Furthermore, the incorporation of the invention allows a greater diversity of total combinations, in that without the geometric orientation requirement, a given combination of matching symbols is either a winning combination or it is not. With the invention, a combination of matching symbols could be a winning combination if the symbols are in the proper orientation to form a geometric figure, or a non-winning combination if they are in the proper places but not in the proper orientation to form a geometric figure.

It will be obvious to those of ordinary skill in the art that the invention can be practiced either as a mechanical device by using "reels" or other spinning mechanisms which are oriented in a horizontal and/or vertical manner, or by using a video display controlled by a computer of some kind and simply drawing the elements and the virtual motion thereof. While it is theoretically possible to incorporate both a simple horizontal, a simple vertical, and/or a multidimensional movement in a mechanical device, it is strongly preferred, but not required, to practice the invention as a video display controlled by a computer of some kind. This would allow infinitely variable motion and varied game elements, all of which could incorporate, to whatever desired degree, the elements of traditional slot machine play, but incorporate the invention's teaching of geometrically aligned game element placement. It would also allow players to easily exercise some form of skill to control, or influence, the outcome of any particular game by programming input opportunities for players based on memory, dexterity, knowledge, or any other player skill or combination of skills.

While the description above details the preferred and best mode(s) of practicing the invention, many other configurations and variations are possible. For example:

1) The invention need not be practiced as a gaming unit, but could be a coin-operated amusement device, a home gaming system, or any other appropriate system.
2) The invention could be incorporated into a larger system of games which communicate with each other, allow play against other players, or form a competition or a cooperative of competing teams rather than an exercise of individual chance or skill.

Accordingly, the scope of the invention should be determined not by the embodiment(s) illustrated, but by the claims below and their equivalents.

What is claimed is:

1. A gaming apparatus comprising:

an electronic processing unit, and, a display which communicates with the unit, where the display exhibits a two dimensional array of rows and columns of display spaces on which an assembly of substantially identical symbols is presented, wherein the symbols comprise a first group rotatably oriented with a first visual orientation relative to a selected line of the array and a second group rotatably oriented with a second visual orientation relative to the selected line of the array, wherein the second visual orientation is different from the first visual orientation; and wherein in a first winning assemblage, at least three symbols in one of the first or second groups are located adjacent to each other in a linear arrangement, the linear arrangement extends at least across a plurality of different rows.

2. An apparatus as in claim 1 wherein the linear arrangement extends across a plurality of different columns.

3. An apparatus as in claim 2 which includes a memory unit, the memory unit stores a plurality of selectable game symbols which can be displayed.

4. An apparatus as in claim 3 wherein at least some of the symbols are elongated in shape, and, their respective visual orientations correspond to an angle, less than ninety degrees, relative to a selected row of the display.

5. An apparatus as in claim 3 wherein some of the symbols include a first elongated portion joined to a second elongated portion with the portions forming a selected angle relative to each other.

6. An apparatus as in claim 5 where the angle is on the order of ninety degrees.

7. An apparatus as in claim 5 wherein a second winning assemblage different from the first winning assemblage is presented in the display, wherein the second winning assemblage includes at least two different symbols, adjacent to one another, such that a visual linear arrangement extends from at least one symbol to the other symbol.

8. A gaming apparatus comprising:

a control array wherein a player operates the gaming apparatus;

a display;

a plurality of substantially identical geometrically oriented game elements presented on the display, wherein at least two but fewer than all elements have a common rotational orientation relative to a selected line of the display with at least one member of the plurality having a different rotational orientation relative to the selected line; and a computer operable to:

display the plurality of elements;

determine if at least three substantially identical adjacent elements are in a configuration wherein every pair of adjacent elements includes two elements that share the common rotational orientation relative to the line; and provide an award to the player for each winning configuration comprising at least three adjacent elements wherein every pair of adjacent elements includes two elements that share the common rotational orientation relative to the line.

9. A gaming apparatus comprising:

a control array wherein a player operates the gaming apparatus;

a display;

a plurality of substantially identical, geometrically oriented game elements presented on the display, wherein a first group of the game elements is oriented in a first direction relative to a selected line and a second group of the game elements is oriented in a second direction, different from the first direction, relative to the selected line wherein a third different element includes connected regions that extend in both the first and second directions; and a computer operable to:

display the plurality of elements;

determine if at least three adjacent elements including at least one from the first group and one from the second group, with the third element therebetween are in a configuration wherein every pair of the adjacent elements at least in part share a common orientation relative to each other; at least one pair of the adjacent elements is oriented along the first direction; and at least one pair of the adjacent elements is oriented in the second direction; and provide an award to the player for each winning configuration comprising at least three adjacent elements wherein every pair of the adjacent elements includes two elements that, at least in part, share a common orientation relative to each other;

at least one pair of adjacent elements is oriented along the first direction; and at least one pair of adjacent elements is oriented along the second direction.

10. A gaming apparatus comprising:

an electronic processing unit; and a display which communicates with the unit, where the display exhibits a two dimensional array of rows and columns of display space on which a plurality of substantially identical symbols is presented, some of the symbols have a first rotational orientation relative a line of the display, other symbols have a second, different rotational orientation relative to the line of the display wherein the processing unit provides an award to a player for a linearly displayed group of adjacent symbols having only the first rotational orientation where some members of the group are displayed on different rows than other members.

11. An apparatus as in claim 10 where some members of the group are displayed on different columns than other members.

12. An apparatus as in claim 11 wherein the awarded group of adjacent symbols includes at least three symbols.

13. A game playing apparatus comprising:

an electronic processing unit; and a display which communicates with the unit, where the display exhibits a two dimensional array of rows and columns of display space on which a plurality of substantially identical symbols is presented, some of the symbols are oriented at a first angle relative a line of the display, other symbols are oriented at a second, different, angle relative to the line of the display wherein the processing unit provides an award to a player for a linearly displayed group of adjacent symbols from the plurality all of which are oriented at the first angle relative to the line of the display.

* * * * *